United States Patent [19]

Ohsawa

[11] 4,341,958

[45] Jul. 27, 1982

[54] YARN-BREAK/YARN-STOP DETECTING DEVICE

[76] Inventor: Shiuji Ohsawa, No. 10-2, 2-chome, Tsutsumi-cho, Kiryu City, Gumma Prefecture, Japan

[21] Appl. No.: 123,059

[22] Filed: Feb. 20, 1980

[30] Foreign Application Priority Data

Aug. 21, 1979 [JP] Japan ..... 54-114031

[51] Int. Cl.[3] ..... G01N 21/86

[52] U.S. Cl. ..... 250/561; 356/238

[58] Field of Search ..... 250/561, 562, 571, 572; 356/238; 19/0.21, 0.25; 57/81; 66/158, 161; 28/187; 242/37 R; 139/273 A, 336

[56] References Cited

U.S. PATENT DOCUMENTS 2,991,685 7/1961 Van Dongeren ..... 250/562 X 3,158,852 11/1964 Schacher ..... 250/561 X 3,712,743 1/1973 Harris et al. ..... 250/572 X 4,150,699 4/1979 Suekane ..... 250/561 X

*Primary Examiner*—David C. Nelms

*Assistant Examiner*—Edward P. Westin

*Attorney, Agent, or Firm*—Martin Smolowitz

[57] ABSTRACT

In a photoelectric yarn-break/yarn-stop detecting device in which a light emitter element and a photoelectric transducer element are positioned in such a manner that the yarn to travel through the detecting device passes through the beam of light emitted from the light emitter element to the photoelectric transducer element for detecting a break or a stop of the yarn in the absence of noises in the signal current produced by the photoelectric transducer element, the light emitter and photoelectric transducer elements and the path of the light from the light emitter element to the photoelectric transducer element are enclosed within a structure adapted to prevent passage of light and an ingress of dust and flue from the outside of the detecting device.

27 Claims, 5 Drawing Figures

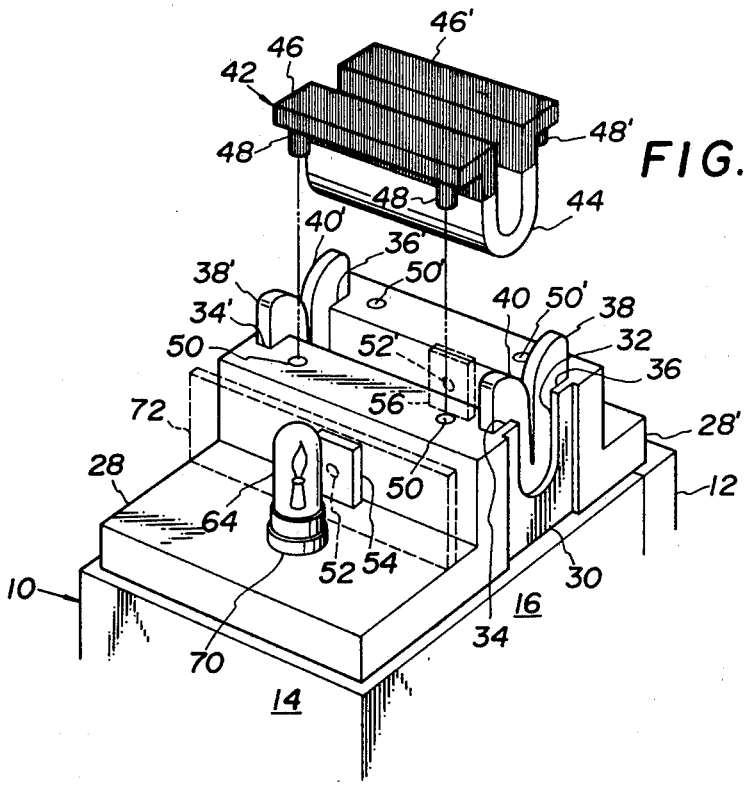
FIG. 4
FIG. 5
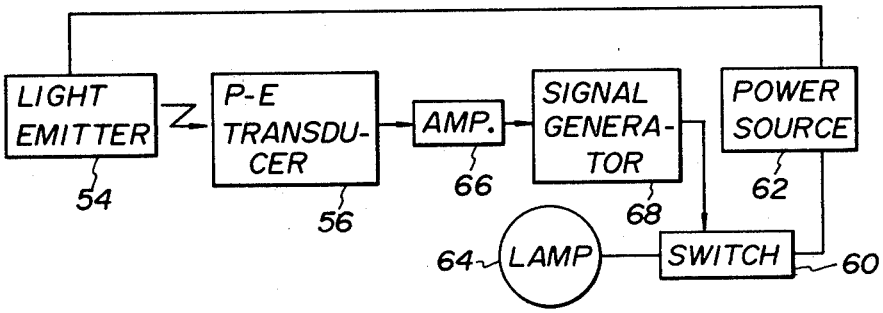

YARN-BREAK/YARN-STOP DETECTING DEVICE

FIELD OF THE INVENTION

The present invention relates to a yarn-break/yarn-stop detecting device for detecting a break or a stop of a yarn trevelling in a textile machine to process or handle any vegetable, animal, mineral, artificial or synthetic yarns, threads or filaments.

BACKGROUND OF THE INVENTION

A conventional yarn-break/yarn-stop detecting device for use in a textile machine comprises light emitter and photoelectric transducer elements incorporated in a grooved housing and positioned in alignment with each other across the groove in the housing. Between the light emitter and photoelectric transducer elements are positioned glass windows which are respectively located adjacent the light emitter and photoelectric transducer elements so that a beam of light emanating from the light emitter element is incident on the photoelectric transducer element through the two glass windows.

In a prior-art yarn-break/yarn-stop detecting device of this nature, it is important that the light emitter and photoelectric transducer elements be arranged in such a manner that the respective glass windows for the light emitter and transducer elements are angled to avoid direct exposure to external light and deposition of dust and flue on the glass windows. If external light is permitted to reach the glass windows, especially the glass window for the photoelectric transducer element, the detecting device may be actuated erroneously in the absence of a failure in the yarn being passed through the detecting device. On the other hand, dust and flue deposited on the glass windows will critically lessen the luminous intensity of the light to be incident on the photoelectric transducer elements through the glass windows.

In order that the light emitter and photoelectric transducer elements in such a manner as to avoid these problems, various restrictions are encountered in designing and engineering the detecting device and adds to the complexity of the overall construction of the device.

When, furthermore, the detecting device is to be installed in the neighborhood of illuminating lamps, it is important that the detecting device be located at a sufficient distance from each of the lamps and arranged so that the glass windows for the light emitter and photoelectric transducer elements are positioned at such angles with respect to the individual lamps that the light emanating from the lamp will not reach the glass windows. This requirement places added restrictions on the installation and placement of the detecting device in a textile machine.

An object of the present invention is to provide an improved yarn-break/yarn-stop detecting device eliminating these drawbacks in prior-art devices of the described nature.

SUMMARY OF THE INVENTION

In accordance with the present invention, such an object is accomplished in a yarn-break/yarn-stop detecting device having a lateral direction parallel with the direction in which a yarn is to travel through the detecting device and a front-and-rear direction perpendicular to the lateral direction, comprising in combination a casing structure, a yarn passage assembly fast on the casing structure and formed with a gap longitudinally extending in a lateral direction of the detecting device, the yarn passage assembly including a transparent portion received in the gap, a light emitter element fixedly positioned with respect to the yarn passage assembly and arranged to be capable of projecting a substantially constant beam of light through the transparent portion of the yarn passage assembly in a predetermined front-and-rear direction of the detecting device when the light emitter element is electrically energized, a photoelectric transducer element fixedly positioned with respect to the yarn passage assembly and located substantially in alignment with said light emitter element across the transparent position of the yarn passage assembly in the aforesaid predetermined front-and-rear direction for being operative to produce an electric current when irradiated with the beam of light emitted from the light emitter element and incident on the transducer element through the transparent portion of the yarn passage assembly, output delivery means operative to produce an output signal when actuated electrically, and a control circuit electrically intervening between the photoelectric transducer element and the output delivery means for actuating the output delivery means when the current produced by the transducer element is in a predetermined condition.

In a yarn-break/yarn-stop detecting device thus constructed and arranged basically, the yarn passage assembly may comprise first and second bracket members fixedly positioned with respect to the casing structure and spaced apart from each other in a front-and-rear direction of the detecting device for forming said gap therebetween. In this instance, the aforesaid bracket members may be respectively formed with apertures which are substantially aligned with each other across the transparent portion of the yarn passage assembly in a front-and-rear direction of the detecting device, the light emitter element and the photoelectric transducer element being located adjacent the apertures in the first and second bracket members, respectively. In this instance, the light emitter element and the photoelectric transducer element are fixedly mounted on the first and second bracket members, respectively, and are located outwardly of the apertures in the first and second bracket members, respectively, in a front-and-rear direction of the detecting device.

The yarn passage assembly may further comprise a dust-proof plug member having a portion constituting said transparent portion of the yarn passage assembly, the transparent portion being closely received in said gap and being detachably in contact with both of the bracket members. The dust-proof plug member may further have a pair of ledge portions marging out of the transparent portion in opposite front-and-rear directions of the detecting device and detachably fitted to the bracket members, respectively.

The yarn passage assembly may further comprise a pair of yarn guide members detachably fitted to the bracket members and spaced apart from each other across a portion of the aforesaid gap in a lateral direction of the detecting device, each of the yarn guide members being formed with a groove which is at least partially open in the gap, the respective grooves in the yarn guide members being substantially aligned with each other across the above mentioned portion of the gap. In this instance, each of the bracket members is formed with a pair of grooves which are substantially parallel with each other and which are open to said gap, the grooves in one of the bracket members being substantially aligned with the grooves, respectively, in the other bracket member, the yarn guide members being detachably fitted to the bracket members through the grooves in the bracket members.

BRIEF DESCRIPTION OF THE DRAWINGS

The features and advantages of a yarn-break/yarn-stop detecting device according to the present invention will be more clearly appreciated from the following description taken in conjunction with the accompanying drawings, in which:

FIG. 4 is a perspective view showing, to an enlarged scale, the yarn passage assembly forming part of the detecting device embodying the present invention; and FIG. 5 is a block diagram schematically showing a control circuit forming part of the detecting device embodying the present invention.

DESCRIPTION OF THE PREFERRED EMBODIMENT

Figure 1:
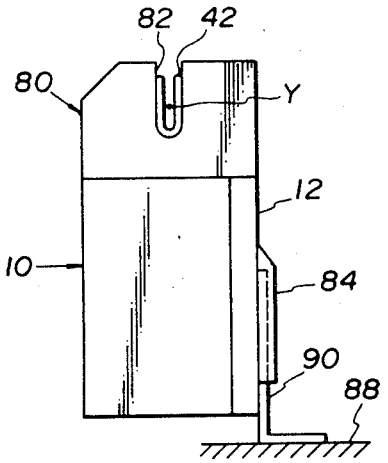
FIG. 1 is a side elevation view of a yarn-break/yarn-stop device embodying the present invention.
Figure 2:
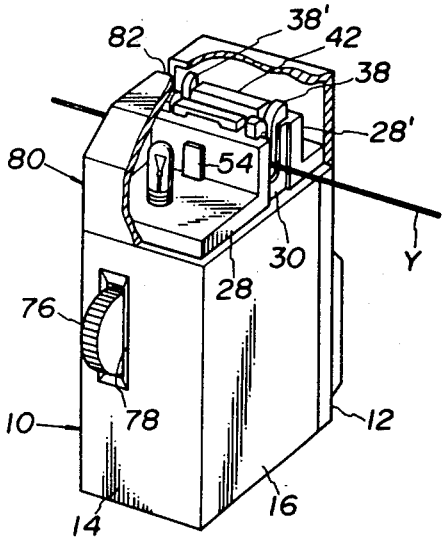
FIG. 2 is a partially cut-away perspective view of the embodiment of the present invention.

As will be seen from the drawings, particularly from FIGS. 1 and 2 thereof, a yarn-break/yarn-stop detecting device according to the present invention has a lateral direction parallel with the direction in which a yarn Y to be processed or handled in a textile machine (not shown) is to travel linearly during operation of the textile machine and a front-and-rear direction perpendicular to the lateral direction. In the description to follow, the yarn Y is assumed to be hauled to travel in a horizontal direction so that the lateral and front-and-rear measurements of the yarn-break/yarn-stop detecting device embodying the present invention are also assumed to be horizontal. It should however be borne in mind that such an assumption is merely for the sake of convenience of description and the lateral and front-and-rear directions of a yarn-break/yarn-stop detecting device according to the present invention may be directed arbitarily depending upon the direction in which the yarn Y to be handled by the detecting device is to be hauled to travel linearly.

Figure 3:
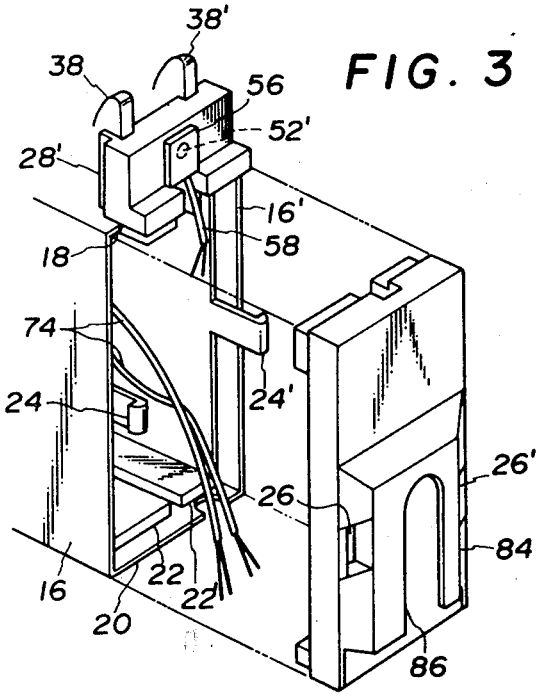
FIG. 3 is a fragmentary perspective view showing a rear portion of the detecting device embodying the present invention.

Referring to FIGS. 1 to 3 of the drawings, the yarn-break/yarn-stop detecting device embodying the present invention comprises a hollow, generally box-shaped casing structure 10 having an open rear end and a rear closure member 12 detachably assembled to the casing structure 10 and closing the open rear end of the casing structure 10. The casing structure 10 in turn comprises a front wall 14 (FIG. 2), a pair of side walls 16 and 16' (FIGS. 2 and 3) extending rearwardly from the opposite side ends of the front wall 14 and spaced apart substantially in parallel from each other, and a top wall 18 (FIG. 3) having a substantially flat upper face. The walls 14, 16, 16' and 18 and a bottom wall 20 of the casing structure 10 or two or more of these walls may be constructed intergrally with each other or, if desired, may be respectively constituted by members which are formed separately of each other and which are bonded or otherwise securely held together by suitable fastening means (not shown).

As illustrated in FIG. 3, the casing structure 10 further comprises a pair of inner reinforcement members 22 and 22' which are bonded or otherwise securely attached to the inner faces of the side walls 16 and 16', respectively, of the casing structure 10. The inner reinforcement members 22 and 22' have arm portions 24 and 24', respectively, projecting rearwardly beyond the rear ends of the side wall portions 16 and 16', respectively, of the casing structure 10 and each having a hooked rear or leading end. On the other hand, the rear closure member 12 is formed with a pair of slots 26 and 26' which are adapted to have the respective arm portions 24 and 24' of the reinforcement members 22 and 22' releasably passed therethrough so that the closure member 12 is detachably fitted to the casing structure 10. Each of the casing 10 and the rear closure member 12 thus configured is preferably constructed of a rigid synthetic resin such as a thermosetting or thermoplastic polymer or copolymer.

As illustrated to an enlarged scale in FIG. 4, the casing structure 10 has securely mounted on the upper face of its top wall 18 a yarn passage assembly including first and second or front and rear bracket members 28 and 28' each having a generally L-shaped cross section and thus consisting of a substantially flat, horizontal base portion bonded or otherwise securely attached to the upper face of the top wall 18 of the casing structure 10 and an upstanding wall portion projecting upwardly from one end of the base portion and having a substantially flat upper end face. The two bracket members 28 and 28' are positioned in such a manner that the respective upstanding wall portions thereof are spaced apart substantially in parallel from each other in a front-and-rear direction of the detecting device and that the respective base portions of the bracket members 28 and 28' extend forwardly and rearwardly, respectively, from the lower ends of the respective upstanding wall portions of the bracket members 28 and 28'. Between the respective upstanding wall portions of the bracket members 28 and 28' is thus formed an elongated gap longitudinally extending in a lateral direction of the detecting device and having a generally rectangular or substantially square-shaped cross section having a lower end defined by the upper face of the top wall 18 of the casing structure 10. The spacing between respective upstanding wall portions of the bracket members 28 and 28' may be selected arbitarily but is herein assumed to be approximately 6 millimeters by way of example. Furthermore, the respective base portions of the bracket members 28 and 28' may be shaped and sized substantially similarly to each other or may have different measurements especially in a front-and-rear direction of the detecting device but it is important that the respective upstanding wall portions of the bracket members 28 and 28' have substantially equal measurements especially in height so that the respective upper end faces of the wall portions are substantially flush with each other and thus lie substantially in a common horizontal plane parallel with the upper face of the top wall 18 of the casing structure 10. For the reason that will be understood as the description proceeds, the front and rear side end faces of the front bracket member 28 and the rear and side end faces of the rear bracket member 28' are slightly offset inwardly from the outer ends of the upper face of the top wall 18 of the casing structure 10 as will be seen from FIG. 4. The bracket members 28 and 28' are preferably constructed of a rigid synthetic resin such as for example a thermoplastic or thermosetting polymer or copolymer and may be colored dark or coated with a dark colored material so as to minimize the reflection of light from the external surfaces thereof. For the same purpose, each of the casing structure 10 and the rear closure member 12 may be partially or in it entirety colored dark or coated with a dark colored material. If desired, furthermore, the bracket members 28 and 28' may be constructed as integral portions of the casing structure 10 or as bracket portions of a unitary member consisting of the bracket portions and a pair of side wall portions connecting the bracket portions together adjacent the opposite lateral ends of the upstanding wall portions of the bracket portions. In FIG. 4, one of such bracket portions is indicated at 30 and is shown formed with a generally U-shaped slot 32 which is open upwardly.

The front bracket member 28 has formed in its upstanding wall portion a pair of grooves 34 and 34' extending vertically between the upper and lower ends of the upstanding wall portion and open rearwardly to the gap between the respective upstanding of the bracket members 28 and 28', the grooves 34 and 34' being located adjacent the opposite lateral ends, respectively of the upstanding wall portion of the bracket 28. Likewise, the rear bracket member 28' has formed in its upstanding wall portion a pair of grooves 36 and 36' extending vertically between the upper and lower ends of the upstanding wall portion and open forwardly to the gap between the respective upstanding wall portions of the bracket members 28 and 28', the grooves 36 and 36' being located adjacent the opposite lateral ends, respectively, of the upstanding wall portions of the bracket members 28 and 28'. The grooves 34 and 36 in the respective upstanding wall portions of the front and rear bracket members 28 and 28' are substantially aligned with each other in a front-and-rear direction of the detecting device and, likewise, the grooves 34' and 36' in the respective upstanding wall portions of the bracket members 28 and 28' are substantially aligned with each other in a front-and-rear direction of the detecting device.

The yarn passage assembly further includes a pair of yarn guide members 38 and 38'. The yarn guide member 38 is formed with a groove 40 and is detachably fitted to the bracket members 28 and 28' through the grooves 34 and 36 and, likewise, the yarn guide member 38, is formed with a groove 40, and is detachably fitted to the bracket members 28 and 28' through the grooves 34' and 36'. Each of the grooves 40 and 40' is open upwardly and extends downwardly from the open upper end, terminating at a generally semicircularly curved lower end. The respective grooves 40 and 40' in the yarn guide members 38 and 38' are substantially aligned with each other in a lateral direction of the detecting device through the gap between the respective upstanding wall portions of the bracket members 28 and 28'. The width of each of the grooves 40 and 40' is such that a yarn Y passed through the grooves 40 and 40' is permitted to freely travel therethrough in a predetermined direction in the gap between the respective upstanding wall portions of the bracket members 28 and 28'. In FIG. 4, each of the grooves 40 and 40' is further shown to be gradually enlarged toward its upper end. The yarn guide members 38 and 38' are preferably constructed of aluminous porcelain.

To the bracket members 28 and 28' is further detachably fitted a dust-proof plug member 42 consisting of a transparent grooved portion 44 having a generally U-shaped cross section and formed with a groove which is open upwardly and a pair of elongated ledge portions 46 and 46' projecting in opposite directions from the upper ends of the grooved portion 44 and extending substantially in parallel with each other across the upper end of the groove in the ledge portion 44. The grooved portions 46 and 46' are coated with a dark-colored material and have flat lower faces having projections 48 protruding downwardly from the lower face of the ledge portion 46 and projections 48' (only one of which is seen in FIG. 4) protruding downwardly from the lower face of the ledge portion 46'. The upstanding wall portions of the bracket members 28 and 28' are formed with holes 50 and 50', respectively, which are axially open upwardly and which are located to correspond to the locations of the projections 48 and 48', respectively, of the plug member 42. The plug member 42 is thus detachably fitted to the bracket members 28 and 28' with its transparent grooved portion 44 closely received between the respective upstanding wall portions of the bracket members 28 and 28' and its projections 48 and 48' closely inserted into the holes 50 and 50', respectively, in the upstanding wall portions of the bracket members 28 and 28', as will be seen from the illustration of FIG. 2. The length of the plug member 42 is substantially equal to or slightly smaller than the distance between the respective inner faces of the yarn guide members 38 and 38' so that the plug member 42 has its lengthwise end faces closely contacted by or located in close proximity to the respective inner faces of the guide members 38 and 38'. The plug member 42 being thus fitted to the bracket members 28 and 28', the grooves 40 and 40' formed in the yarn guide members 38 and 38', respectively, are aligned with each other through the groove in the grooved portion 44 of the plug member 42. The plug member 42 thus constructed and arranged is constructed preferably of transparent glass or a transparent and rigid synthetic resin such as an acryl resin or other thermoplastic or thermosetting polymer or copolymer.

The upstanding wall portions of the front bracket members 28 and 28' are formed with apertures 52 and 52', respectively, which are aligned with each other in a front-and-rear direction of the detecting device across the transparent grooved portion 44 of the dust-proof plug member 42. A steady-state light emitter element 54 constituted by, for example, an electroluminescent diode is fixedly attached to the outer or front face of the upstanding wall portion of the bracket member 28 and is arranged in such a manner as to project into or to be located adjacent to the aperture 52 in the wall portion of the bracket member so that a beam of light is emitted from the light emitter element 54 and is directed to the aperture 52' in the upstanding wall portion of the rear bracket member 28' through the aperture 52 in the upstanding wall portion of the front bracket member 28 and the front and rear walls of the transparent grooved portion 44 of the plug member 42 when the light emitter element 54 is electrically energized from an external power source.

On the other hand, the upstanding wall portion of the rear bracket member 28' had fixedly attached to its outer or rear face a photoelectric transducer element 56 (FIGS. 3 and 4) which is arranged in such a manner as to be exposed to the aperture 52' in the wall portion of the bracket member 28' so that the transducer element 56 is caused to produce an electric current when a beam of light is directed into the aperture 52' and is incident on the transducer element 56. The photoelectric transducer element 56 thus arranged is constituted by, for example, a phototransistor and is operative to produce a photocurrent which is continuously variable with the luminous intensity of the light incident on the transducer element, as is well known in the art.

The photoelectric transducer element 56 is connected by lead wires 58 (FIG. 4) to a control circuit including a normally-open switching circuit 60 which intervenes between a suitable a.c. and/or d.c. power source unit 62 and suitable output delivery means such as, for example, an electric warning lamp 64 as schematically illustrated in FIG. 5. In FIG. 5, the photoelectric transducer element 56 is shown connected to the switching circuit 60 through a series combination of an amplifier circuit 66 having an input terminal connected to the output terminal of the transducer element 56 and a noise-responsive signal generator circuit 68 having an input terminal connected to the output terminal of the amplifier circuit 66 and an output terminal connected to an actuating element (not shown) of the switching circuit 60. As will be described in more detail, the noise-responsive signal generator circuit 68 is responsive to the noises included in the output current from the amplifier 66 and accordingly in the noises included in the output current delivered signal from the photoelectric transducer element 56 and is adapted to produce an output signal in the absence of such noises. The switching circuit 60 may comprise a transistor, a thyristor or any other type of semiconductor switching element having a control or trigger terminal and is adapted to be rendered electrically conductive when such a control or trigger terminal thereof is energized by the output signal delivered from the signal generator circuit 68. In the presence of noises in the output current from the photoelectric transducer element 56, there is no output signal delivered from the signal generator circuit 68 so that the switching circuit 60 is permitted to remain open.

In FIG. 4, the warning lamp 64 is shown having a bayonet base detachably fitted to a bayonet socket 70 which is fixedly mounted on the base portion of the front bracket member 28. When an a.c. voltage is to be used as the power source for the light emitter element 54, a suitable light shield member 72 may be positioned between the warning lamp 64 and the light emitter element 54 on the outer or front face of the upstanding wall portion of the bracket member 28, as indicated by broken lines in FIG. 4. The warning lamp 64 is connected to the switching circuit 60 (FIG. 5) by lead wires 74 (FIG. 4). In the embodiment herein illustrated, the power source unit 62 shown in FIG. 5 is assumed, by way of example, as consisting of an a.c. power supply section for energizing the warning lamp 64 and a d.c. power supply section connected to the light emitter element 54. If desired, a suitable voltage regulator (not shown) may be provided between the light emitter element 54 and the d.c. power supply section of the power source unit 62 so that the voltage to be applied to the light emitter element 54 can be adjusted as desired. Such a voltage regulator may be manually operated by means of a dial 76 projecting in part from the front wall 14 of the casing structure 10 through a slot 78 formed in the front wall 14 as shown in FIG. 2. The dial 76 may also be used for operating a switch (not shown) which may be provided between the power source 62 and a convenience outlet of a mains power source.

The bracket members 28 and 28', the warning lamp 54 and the various members and elements mounted on the top wall 18 of the casing structure 10 are enclosed within a generally box-shaped transparent or semitransparent cap member 80 which is detachably mounted on outer marginal portions of the upper face of the top wall 18 of the casing structure 10 as illustrated in FIGS. 1 and 2. The cap member 80 is formed with a slot 82 which is open upwardly and laterally of the cap member 80 for allowing the yarn Y to extend through the grooves 40 and 40' in the yarn guide members 38 and 38', respectively, and the groove in the grooved portion 44 of the dust-proof plug member 42 without being interfered by the cap member 80.

As will be best seen from FIG. 3, the rear closure member 12 is formed with a rear extension 84 formed with a vertical cavity which is open downwardly and is part rearwardly through a generally U-shaped slot 86. The detecting device as a whole is supported on a suitable stationary support structure 88 by means of a bracket 90 secured to the stationary support structure 88 and having an upstanding tongue portion detachably inserted into the cavity in the rear extension 84 of the closure member 12 as illustrated in FIG. 1.

Description will be hereinafter made regarding the principle of operation of the detecting device thus constructed and arranged.

Throughout operation of the textile machine, a yarn Y is continuously fed through the detecting device and is passed linearly through the grooves 40' in the yarn guide members 38 and 38', respectively, and the groove in the grooved portion 44 of the dust-proof plug member 42. The path of the yarn Y thus passed through the groove in the dust-proof plug member 42 is cut across by the beam of the light directed from the steady-state light emitter element 54 to the photoelectric transducer element 56 through the apertures 52 and 52' in the respective upstanding wall portions of the front and rear bracket members 28 and 28' and the front and rear walls of the transparent grooved portion 44 of the plug member 42. The beam of the light admitted into the aperture 52' in the upstanding wall portion of the rear bracket portion 28' is incident on the photoelectric transducer element 56 and causes the transducer element 56 to produce a photocurrent which varies with the luminous intensity of the light emitted from the light emitter element 54. The yarn Y is stretched under tension between, for example, some yarn supply and take-up means (not shown) of the textile machine and is thus constantly subject to minute vibrations transferred thereto from the yarn supply and take-up means insofar as the yarn Y is continuous between the yarn supply and take-up means and is properly travelling from the yarn supply means to the take-up means. The vibrations of the yarn Y result in frequent and minute fluctuations in the luminous intensity of the light incident on the photoelectric transducer element 56 and accordingly in the current produced by the transducer element 56. The minutely fluctuating current thus delivered from the photoelectric transducer element 56 is fed upon amplification by the amplifier circuit 66 to the noise-responsive signal generator circuit 68. The signal generator circuit 68 is adapted to produce no output signal when the current supplied thereto contains noises. Thus, the actuating element of the normally-open switching circuit 60 remains de-energized in the absence of a signal at the output terminal of the signal generator circuit 68 so that the switching circuit 60 is held open and as a consequence the warning lamp 64 is maintained in a turned-off condition.

In the event the yarn Y breaks at any point between the yarn supply and take-up means or ceases travelling from the yarn supply means toward the take-up means for some reason during operation of the textile machine, the yarn Y is slackened and falls onto the bottom face of the groove in the grooved portion 44 of the dust-proof plug member 42 or is fixedly and tautly stretched between the yarn supply and take-up means. Under such a condition, the constant beam of light emanating from the steady-state light emitter element 54 is permitted to be incident, without being modified or subjected to disturbance, on the photoelectric transducer element 56, which is therefore enabled to produce a constant photocurrent. In response to a constant output current delivered from the amplifier circuit 66, the noise-responsive signal generator circuit 68 is actuated to produce an output signal therefrom and energizes the actuating element of the switching circuit 60. The normally-open switching circuit 60 is now actuated to close and causes the warning lamp 64 to be energized from the a.c. power supply section of the power source unit 62. A yarn/break or yarn/stop condition brought about by the yarn Y is thus visibly indicated by the warning lamp 64 which is now caused to glow within the cap member 80 positioned on the top wall 18 of the casing structure 10.

While it has been assumed that the output delivery means of the detecting device according to the present invention is constituted by the warning lamp 64, such means may comprise a sound-producing warning device such as a buzzer, a suitable stop motion adapted to shut down the textile machine in response to a signal delivered from the signal generator circuit 68 or any combination of the warning lamp, buzzer and stop motion.

In the yarn-break/yarn-stop detecting device herein proposed, the beam of the light directed from the light emitter element 54 through the aperture 52 in the upstanding wall portion of the front bracket member 28 to the photoelectric transducer element 56 through the aperture 52' in the upstanding wall portion of the rear bracket member 28' is effectively isolated from the light outside the detecting device by the dark-coated or dark-colored ledge portions 46 and 46' of the dust-proof plug member 42 and is enabled to reach the photoelectric transducer element 56 without being affected by the external light. When the casing structure 10 and the bracket members 28 and 28' are constructed of or coated with a dark-colored material, the beam of the light to be incident on the photoelectric transducer element 56 from the light emitter element 54 is isolated from the external light not only by the ledge portions 46 and 46' of the dust-proof plug member 42 but by the casing structure 10 and the bracket members 28 and 28'. The dust-proof plug member 42 is conducive not only to isolating the light beam from the light emitter element 54 from the external light but also to preventing an ingress of dust and flue into the apertures 52 and 52' in the respective upstanding wall portions of the bracket members 28 and 28' and deposition of dust and flue on the light emitter and photoelectric transducer elements 54 and 56. Furthermore, the dust-proof plug member 42 can be easily disassembled from the bracket members 28 and 28' by pulling out the downward projections 48 and 48' of the plug member 42 from the holes 50 and 50' in the upstanding wall portions of the bracket members 28 and 28', respectively, when it is desired to remove dust and flue from the inner surface of the grooved portion 44 of the plug member 42.

What is claimed is:

1. A yarn-break/yarn-stop detecting device having a lateral direction parallel with the direction in which a yarn is to travel through the detecting device and a front-and-rear direction perpendicular to said lateral direction, comprising in combination:

a casing structure;

a yarn passage assembly fast on said casing structure and formed with a gap longitudinally extending in a lateral direction of the detecting device, the yarn passage assembly including a transparent portion received in said gap;

a light emitter element fixedly positioned with respect to said yarn passage assembly and arranged to project a substantially constant beam of light through said transparent portion of the yarn passage assembly in a predetermined front-and-rear direction of the detecting device when the light emitter element is electrically energized, a photoelectric transducer element fixedly positioned with respect to said yarn passage assembly and located substantially in alignment with said light emitter element across said transparent portion of the yarn passage assembly in said predetermined front-and-rear direction for being operative to produce an electric current when irradiated with the beam of light emitter element and incident on the transducer element through said transparent portion of the yarn passage assembly, output delivery means operative to produce an output signal when actuated electrically, and a control circuit electrically intervening between said photoelectric transducer element and said output delivery means for actuating the output delivery means when the current produced by the transducer element is in a predetermined condition, wherein: said yarn passage assembly comprises first and second bracket members fixedly positioned with respect to said casing structure and spaced apart from each other in a front-and-rear direction of the detecting device for forming said gap therebetween and a dust-proof plug member having a portion constituting said transparent portion of the yarn passage assembly, said transparent portion being closely received in said gap and being detachably in contact with both of said bracket members, said transparent portion of said plug member having a generally U-shaped cross section and has front and rear walls which are spaced apart from each other in a front-and-rear direction of the detecting device and which are closely and detachably in contact with said bracket members, respectively.

2. A yarn-break/yarn-stop detecting device as set forth in claim 1, in which said bracket members are respectively formed with apertures which are substantially aligned with each other across said transparent portion of said yarn passage assembly in a front-and-rear direction of the detecting device, said light emitter element and said photoelectric transducer elements being located adjacent said apertures in the first and second bracket members, respectively.

3. A yarn-break/yarn-stop detecting device as set forth in claim 2, in which said light emitter element and said photoelectric transducer element are fixedly mounted on said first and second bracket members, respectively, and are located outwardly of said apertures in the first and second bracket members, respectively, in a front-and-rear direction of the detecting device.

4. A yarn-break/yarn-stop detecting device as set forth in any one of claims 1, 2 and 3, inclusive, in which said output delivery means comprises an electric lamp supported by said yarn passage assembly.

5. A yarn-break/yarn-stop detecting device as set forth in claim 2 or 3, in which each of said bracket members is constructed of a dark-colored material.

6. A yarn-break/yarn-stop detecting device as set forth in claim 2 or 3, in which each of said bracket members is coated with a dark-colored material.

7. A yarn-break/yarn-stop detecting device as set forth in any one of claims 1, 2 and 3, inclusive, in which said control circuit comprises a noise-responsive signal generator circuit adapted to produce an output signal in the absence of noises in a signal current supplied to the generator circuit and to produce no output signal in the presence of noises in said signal current.

8. A yarn-break/yarn-stop detecting device as set forth in claim 1, in which said dust-proof plug member further has a pair of ledge portions merging out of said transparent portion in opposite front-and-rear directions of the detecting device and detachably fitted to said bracket members, respectively.

9. A yarn-break/yarn-stop detecting device as set forth in claim 8, in which each of said ledge portions of the plug member is constructed of a transparent material and is coated with a dark-colored material.

10. A yarn-break/yarn-stop detecting device as set forth in claim 8, in which each of said ledge portions of the plug member is constructed of a dark-colored material.

11. A yarn-break/yarn-stop detecting device as set forth in claim 4, in which said electric lamp is positioned in the neighborhood of said light emitter element and in which said yarn passage assembly comprises a light-shield member positioned between said light emitter element and said electric lamp.

12. A yarn-break/yarn-stop detecting device as set forth in any one of claims 8, 9 and 10, in which said dust-proof plug member further has a projection projecting from each of said ledge portions and detachably inserted into a hole formed in each of said bracket members.

13. A yarn-break/yarn-stop detecting device as set forth in any one of claims 2 or 3, in which said yarn passage assembly further comprises a pair of yarn guide members detachably fitted to said bracket members and spaced apart from each other across a portion of said gap in a lateral direction of the detecting device, each of the yarn guide members being formed with a groove which is at least partially open in said gap, the respective grooves in the yarn guide members being substantially aligned with each other across said portion of said gap.

14. A yarn-break/yarn-stop detecting device as set forth in claim 13, in which each of said yarn guide members is constructed of an aluminous porcelain.

15. A yarn-break/yarn-stop detecting device as set forth in claim 13, in which each of said bracket portions is formed with a pair of grooves which are substantially parallel with each other and which are open to said gap, the grooves in one of the bracket members being substantially aligned with the grooves, respectively, in the other bracket member, said yarn guide members being detachably fitted to the bracket members through said grooves in the bracket members.

16. A yarn-break/yarn-stop detecting device as set forth in any one of claims 1, 2 and 3, inclusive, in which said casing structure is constructed at least partially of a dark-colored material.

17. A yarn-break/yarn-stop detecting device as set forth in claim 13, in which said dust-proof plug member further has a pair of ledge portions merging out of said transparent portion in opposite front-and-rear directions of the detecting device and detachably fitted to said bracket members, respectively.

18. A yarn-break/yarn-stop detecting device as set forth in claim 17, in which each of said ledge portions of the plug member is constructed of a transparent material and is coated with a dark-colored material.

19. A yarn-break/yarn-stop detecting device as set forth in claim 17, in which each of said ledge portions of the plug member is constructed of a dark-colored material.

20. A yarn-break/yarn-stop detecting device as set forth in claim 9 or 10, in which each of said bracket members is constructed of a dark-colored material.

21. A yarn-break/yarn-stop detecting device as set forth in claim 18, in which each of said bracket members is constructed of a dark-colored material.

22. A yarn-break/yarn-stop detecting device as set forth in any one of claims 1, 2 and 3, inclusive, in which said casing structure is at least partially coated with a dark-colored material.

23. A yarn-break/yarn-stop detecting device as set forth in claim 13, in which said dust-proof plug member further has a projection projecting from each of said ledge portions and detachably inserted into a hole formed in each of said bracket members.

24. A yarn-break/yarn-stop detecting device as set forth in any one of claims 1, 2 and 3, inclusive, in which said casing structure has an open end and which further comprises a closure member detachably fitted to said casing structure for closing said open end of the casing structure.

25. A yarn-break/yarn-stop detecting device as set forth in claim 24, in which said casing structure comprises a hooked member disengageably engaging said closure member through a slot formed in the closure member for having the closure member detachably fitted to the casing structure.

26. A yarn-break/yarn-stop detecting device as set forth in claim 25, in which said closure member is constructed at least partially of a dark-colored material.

27. A yarn-break/yarn-stop detecting device as set forth in claim 25, in which said closure member is at least partially coated with a dark-colored material.

* * * * *